US006657594B2

(12) United States Patent
Anderson

(10) Patent No.: US 6,657,594 B2
(45) Date of Patent: Dec. 2, 2003

(54) PLASMA ANTENNA SYSTEM AND METHOD

(75) Inventor: Theodore R. Anderson, Galway, NY (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/066,510

(22) Filed: Jan. 29, 2002

(65) Prior Publication Data

US 2003/0142021 A1 Jul. 31, 2003

(51) Int. Cl.[7] ..... H01Q 1/26
(52) U.S. Cl. ..... 343/701
(58) Field of Search ..... 343/701, 834; 315/111.21

(56) References Cited

U.S. PATENT DOCUMENTS 6,046,705 A * 4/2000 Anderson ..... 343/834
6,087,992 A * 7/2000 Anderson ..... 343/701
6,087,993 A * 7/2000 Anderson et al. ..... 343/701
6,118,407 A * 9/2000 Anderson ..... 343/701
6,169,520 B1 * 1/2001 Anderson ..... 343/701
6,369,763 B1 * 4/2002 Norris et al. ..... 343/701
6,492,951 B1 * 12/2002 Harris et al. ..... 343/701

* cited by examiner

*Primary Examiner*—James Clinger
*Assistant Examiner*—Minh D A
(74) *Attorney, Agent, or Firm*—James M. Kasischke; Michael F. Oglo; Jean-Paul A. Nasser

(57) ABSTRACT

An antenna system and method for a plurality of plasma antennas driven by means of an optical driver. In one embodiment the driver comprises one or more lasers which may be modulated by one or more electro-optical modulators to produce a modulated laser signal. The modulated laser signal may be supplied to the plasma antenna by optical fibers whereby the photons from the modulated signal impart momentum to the plasma particles. The plasma particles, which may include unbound electrons, oscillate in accord with the modulated laser signal to radiate electromagnetic energy. In one embodiment, the plasma antenna is operated at a frequency near the resonant frequency of the plasma to form a more efficient radiator requiring a smaller size than to a metallic antenna. In another embodiment a plurality of closely spaced plasma antennas are operated with different plasma resonant frequencies such that one plasma antenna is electrically invisible with respect to another plasma antenna.

19 Claims, 1 Drawing Sheet

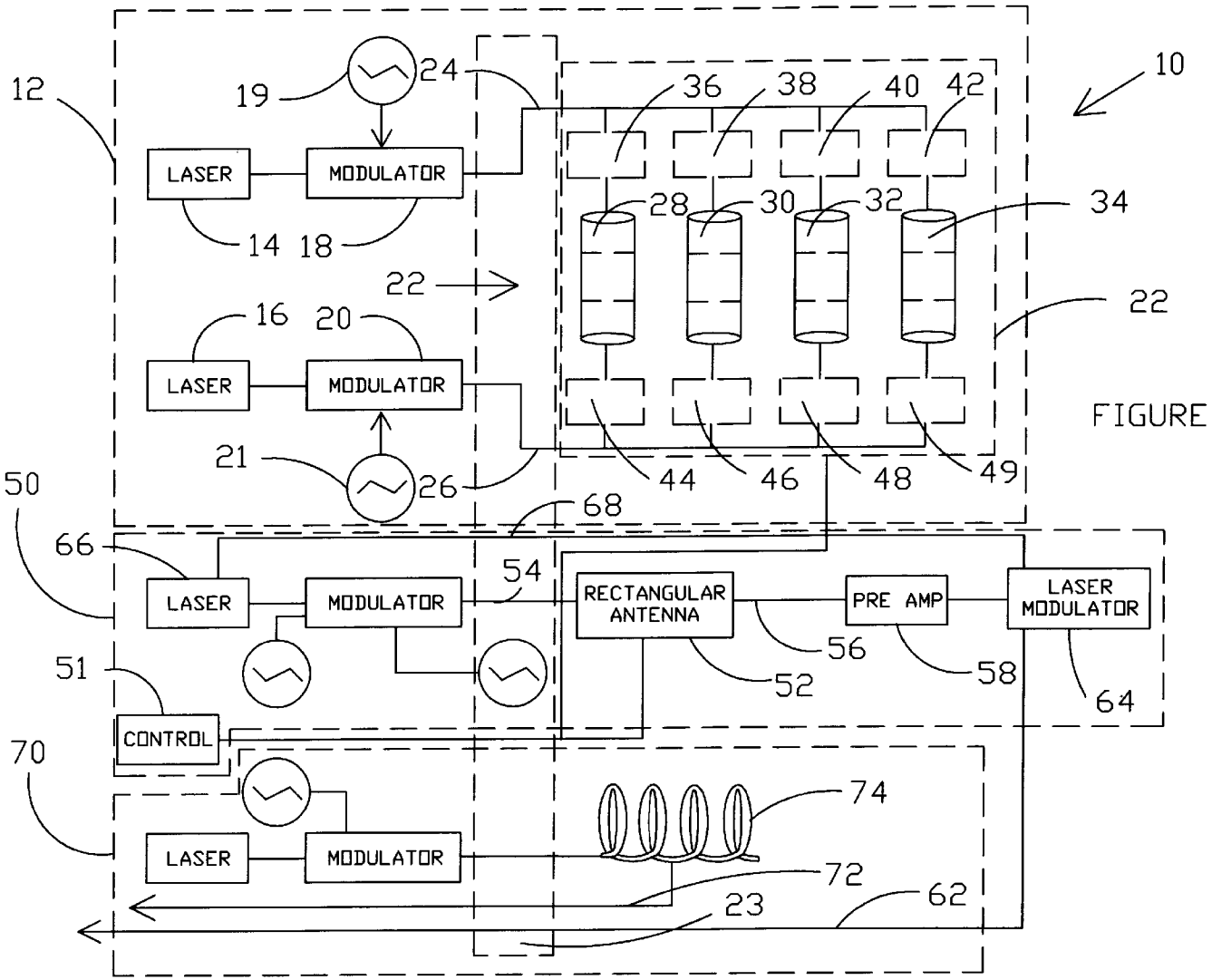
10
22
34
FIGURE
LASER MODULATOR
64
42
40
38
36
32
30
28
49
48
46
44
58
PRE AMP
56
52
RECTANGULAR ANTENNA
68
54
62
74
72
23
24
19
MODULATOR
18
14
LASER
22
20
16
MODULATOR
26
21
LASER
MODULATOR
LASER
CONTROL
MODULATOR
LASER
12
66
50
51
70

PLASMA ANTENNA SYSTEM AND METHOD

STATEMENT OF THE GOVERNMENT INTEREST

The invention described herein may be manufactured and used by or for the Government of the United States of America for Governmental purposes without the payment of any royalties thereon or therefore.

CROSS REFERENCE TO OTHER PATENT APPLICATIONS

Not applicable.

BACKGROUND OF THE INVENTION (1) Field of the Invention

The present invention relates generally to plasma antenna systems and, more specifically, to a laser excited plasma antenna system that may, in one embodiment, be utilized in a submarine.

(2) Description of the Prior Art

Submarine periscopes may typically include numerous antennas which have different shapes for different purposes. Conventional antennas utilized by submarine periscopes are solid metallic antennas and are, therefore, substantially inflexible. Due to the close proximity of the various metallic antennas, electromagnetic coupling is a problem that may affect broadcasting antenna patterns, reception antenna patterns, and antenna gains. The close proximity also creates noise, produces multipath problems, and causes other interference-related problems. Moreover, with the existing number of antennas within the periscope system, space for new antennas is currently a problem for periscope design.

Additionally, transmission lines must carry significant power to drive the antennas for broadcasting signals. These transmission lines are also closely spaced within the periscope tower. Therefore during broadcasting, when significant antenna drive power is applied to the transmission lines, electromagnetic interference may also arise due to the close proximity of transmission lines, antenna power connections, and transmitter power connections.

Patents that show attempts to solve problems related to the above are as follows:

U.S. Pat. No. 3,067,420, issued Dec. 4, 1962, to R. C. Jones et al., discloses a cylindrical plasma lens having a distribution of electron density which is circularly uniform on any given radius and non-uniform as a function of radius of the cylindrical lens. The device includes a means for transmitting electromagnetic energy through the lens in the general direction of one of the radii where the distribution as a function of radius is such that electromagnetic radiation applied at a periphery of the lens in a diametral direction is transmitted from the lens as two waves having wave fronts diverging at equal angles from the diametral direction.

U.S. Pat. No. 3,404,403, issued Oct. 1, 1968, to L. M. Valese et al., discloses a laser beam antenna comprising a laser means for producing at least one laser beam, means coupled to the laser means for repeatably pulsing the laser means, focusing means for focusing the laser beam at different points to thereby ionize a column of air, and means coupling a source of input signals to the base of the ionized column of air.

U.S. Pat. No. 3,544,993, issued Dec. 1, 1970, to Vandenplas et al., discloses a plasma coated antenna wherein an expandable sheath consists almost entirely of positively charged ions that act electrically like a vacuum to isolate the antenna from a layer of plasma which encompasses the antenna. The plasma layer may be maintained over the antenna by a suitable container. The antenna may be selectively tuned by varying either the thickness of the sheath or the density of the plasma.

U.S. Pat. No. 3,719,829, issued Mar. 6, 1973, to J. R. Vaill, discloses an apparatus and method in which a laser beam or other light source of comparable steradiancy is employed to establish a low-level ionization trail through a gas medium, and then auxiliary means external to the optical source is employed to increase the ionization with that initial trail to a high level to form a more highly conductive path over which useful amounts of electrical energy can be conducted for the transmission of intelligence or power.

U.S. Pat. No. 3,914,766, issued Oct. 21, 1975, to R. L. Moore, discloses a pulsating plasma device having a cylindrical plasma column and a pair of field exciter members disposed in spaced parallel relationship to the plasma column. Means are also provided for creating an electrostatic field through which oscillating energy is transferred between the plasma column and the field exciter members.

U.S. Pat. No. 5,594,456, issued Jan. 14, 1997, to Norris et al., discloses an antenna device for transmitting a short pulse duration signal of predetermined radio frequency that eliminates a trailing antenna resonance signal. The device includes a gas filled tube; a voltage source for developing an electrically conductive path along a length of the tube corresponding to a resonant wavelength multiple of the predetermined radio frequency; and a signal transmission source coupled to the tube for supplying a radio frequency signal to the conductive path for antenna transmission. A method for transmitting a short pulse signal without a trailing residual signal is also provided.

U.S. Pat. No. 5,694,498, issued Dec. 2, 1997, to Manasson et al., discloses systems and methods for optically controlled phase shifters. An apparatus includes a proximal rib waveguide and a phase shifter connected to the proximal rib waveguide. The phase shifter includes a first plasma induced modulator connected to the proximal rib waveguide having a first transmission coefficient "a" and including a first branch waveguide connected to the proximal rib waveguide; a first photosensitive semiconductive plasma injector connected to the first branch waveguide; a second plasma induced modulator connected to the proximal rib waveguide having a second transmission coefficient "b" and including a second branch waveguide connected to the proximal rib waveguide; a second photosensitive semiconductive plasma injector connected to the second branch waveguide; a third plasma induced modulator connected to the proximal rib waveguide having a third transmission coefficient "c" and including a third branch waveguide connected to the proximal rib waveguide; and a third photosensitive semiconductive plasma injector connected to the third branch waveguide. The transmission coefficients "a", "b" and "c" are each less than or equal to 1. The systems and methods provide a substantial improvement in that a phased array antenna can be steered with the optically controlled phase shifters using much less controlling energy.

U.S. Pat. No. 5,864,322, issued Jan. 26, 1999, to Pollon et al., discloses an electronic scan antenna for generating an electrically scanned RF beam in response to an incident RF beam having at least one operating frequency band associated therewith including a ground plane for reflecting the incident RF beam and a phasing arrangement of plasma structures operatively coupled to the ground plane. Each plasma structure includes gas containing areas which are reflective at the operating frequency range, when ionized, forming ionized plasma areas. Each ionized plasma area is disposed a first distance from the ground plane, a second distance from adjacent ionized plasma areas and each plasma ionized plasma area has a particular size associated therewith. In this manner, each ionized plasma area, in cooperation with the ground plane, provides a portion of a composite RF beam which has a phase shift associated therewith. The electronic scan antenna of the present invention also includes a control circuit for selectively ionizing the gas containing areas such that the size of each ionized plasma area may be dynamically varied so as to dynamically vary the imparted phase shift. In this manner, the composite RF beam may be electronically scanned.

The above patents do not disclose or contemplate means for utilizing benefits of plasma antennas in a submarine periscope system, do not contemplate driving plasma antennas without creating electromagnetic interference, and do not contemplate a reduced size plasma antenna driven at plasma resonant frequencies. Moreover, the above patents do not disclose multiple plasma antenna systems which may be configured to reduce interference between antennas and/or may be provided within flexible containers to permit shape variations. Consequently, there remains a need for an improved plasma antenna system that may be used for general purposes but which may have particular advantages for use within a submarine periscope antenna system. Those skilled in the art will appreciate the present invention that addresses the above and other problems.

SUMMARY OF THE INVENTION

Accordingly, it is an object of the present invention to provide an improved antenna system and method.

Another object of the present invention is to provide an improved submarine antenna system and method.

A further object of the present invention is to provide an improved plasma antenna system and method.

A still further object of the present invention is to reduce far field antenna radiation interference among closely spaced antenna systems.

These and other objects, features, and advantages of the present invention will become apparent from the drawings, the descriptions given herein, and the appended claims. However, it will be understood that the above listed objects of the invention are intended only as an aid in understanding aspects of the invention, are not intended to limit the invention in any way, and do not form a comprehensive list of objects, features, and advantages.

In accordance with the present invention, an antenna system is disclosed which may comprise one or more plasma antennas wherein the one or more plasma antennas comprise plasma particles and one or more optical drivers to produce photons for colliding with the plasma particles. The optical drivers may further comprise one or more lasers and/or one or more electro-optic modulators. Additional elements may include one or more optical fibers optically connected to the one or more plasma antennas. For instance, a first optical fiber may be connected to each of the one or more plasma antennas and a second optical fiber may be connected to each of the one or more plasma antennas wherein the first optical fiber is connected at a first position on each of the one or more plasma antennas and the second optical fiber is connected at a second position on each of the one or more plasma antennas and the first position may be spaced apart with respect to the second position.

A plasma resonant frequency control may be provided for controlling a resonant frequency of the one or more plasma antennas. Moreover, the optical driver may be operable for driving the one or more plasma antennas at a frequency within a range of about plus or minus twenty percent of a resonant frequency of the one or more plasma antennas.

In one embodiment, the one or more plasma antennas further comprise a plurality of plasma antennas connected as an antenna array to thereby cooperate to transmit a signal. In another embodiment, the one or more plasma antennas may be formed in a shape related to a desired radiation pattern such as a circular profile such as a helix, coil, or circular radiator. In another embodiment, the one or more plasma antennas may have a rectangular profile which may or may not also include a curved profile. As well, one or more flexible, shapeable, expandable, contractible or pliable plasma containers may be utilized for containing the plasmas for the one or more plasma antennas.

In operation, a method for controlling the plasma antenna system to avoid interference between a plurality of plasma antennas may be provided with one or more method steps such as mounting a first plasma container for a first plasma antenna in proximity to a second plasma container for a second plasma antenna, operating the first plasma antenna such that the first plasma antenna has a first plasma antenna resonant frequency, and controlling the second plasma antenna such that the second plasma antenna is effectively electrically invisible to the first plasma antenna. This may be accomplished, for instance, by operating the second plasma antenna such that the second plasma antenna has a second plasma antenna resonant frequency wherein the second plasma antenna resonant frequency is different from the first plasma antenna resonant frequency. For instance, the second plasma antenna resonant frequency may be lower than the first plasma antenna resonant frequency. As another example, the second plasma antenna may be turned off such that the second plasma container temporarily does not contain plasma.

In another embodiment that permits a physically smaller plasma antenna to broadcast as effectively as a larger metallic antenna, a method is provided that may comprise one or more steps such as controlling a resonant frequency of the plasma antenna, and driving the plasma antenna with a radio signal of the same frequency as the resonant frequency of the plasma antenna within a range of about plus or minus twenty percent. In a preferred embodiment of this method, the plasma antenna may preferably but not necessarily be driven with an optical source such that the optical source is modulated by the radio signal. In another embodiment of the invention, the method may comprise mounting the plasma antenna to a submarine periscope and/or attaching one or more optical fibers to the plasma antenna.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying FIGURE wherein the FIGURE discloses one possible embodiment of a schematic block diagram of a plasma antenna system in accord with the present invention.

DESCRIPTION OF THE PREFERRED EMBODIMENT

Referring now to the drawings and more specifically to the FIGURE, there is shown one possible configuration of antenna system 10 in accord with the present invention.

Plasma transmitter antenna array 12 is one aspect of the invention and could be a stand alone antenna system or operate in conjunction with other antennas as discussed subsequently. Plasma transmitter antenna array 12 may utilize one or more lasers for driving plasma antenna array 12 such as, in this example, two lasers 14 and 16. Lasers 14 and 16 may be alternately pulsed or may be continuous lasers. Lasers 14 and 16 may be modulated by use of electro-optical modulators, such as electro-optical modulators 18 and 20. Modulation may be of many types and may utilize one or more signal generators 19 and 21 for modulating the laser light produced by lasers 14 and 16 to thereby produce a modulated laser signal. Electro-optical modulators 18 and 20 may comprise electro-optical crystals. However, it will be understood that numerous methods and devices may be used to produce modulated laser signals within optical fiber lines 24 and 26 for driving plasma antennas 22. Thus, the present invention is not limited to a particular method for modulating a laser signal. In a preferred embodiment, optical fiber lines 24 and 26 may be used to replace transmission lines through a length of periscope system 23.

If the antenna system is to be used in a submarine periscope system, then the standard metallic antennas may be replaced by plasma antennas, such as plasma antennas 22 and/or other plasma antennas, the transmission lines are replaced by optical fibers 24 and 26, and the voltage sources are replaced by lasers 14 and 16. In this way, substantial reductions in electromagnetic interference, noise, and the like are achieved since the signals are light rather than electrical signal.

In one embodiment, each plasma antenna element such as plasma antenna elements 28, 30, 32, and 34 are alternately driven by laser signals in optical fibers 24 and 26. Photons from laser light collide and transfer momentum to plasma particles, such as unbound electrons, within plasma antenna elements 28, 30, 32, and 34. The resulting variations then cause the desired signal to be broadcast. Electro-optical elements 36, 38, 40, 42, 44, 46, 48, and 49 may be used, if desired, to vary the signal phase at each array element to thereby increase and/or control directivity of the array and/or to create a steerable beam.

By driving the antennas 22 at frequencies near the resonance frequency of the plasma in the respective antenna elements 28, 30, 32, and 34, the plasma antenna provides a greater output than would a metallic antenna of the same size thereby reducing the required size of each antenna or antenna element as may be particularly desirable for use in a periscope but may also have other applications where a reduced antenna size is desired. In one embodiment, the driving frequency is near or at least within a range of about twenty percent of the plasma antenna resonant frequency, i.e., the driving frequency is the resonant frequency within the range of plus or minus twenty percent. The plasma may be created by electrodes, lasers, RF heating, and/or combinations of these means. The plasma resonance can typically be controlled by the electrodes, lasers, RF heating, or other means such as by temperature control and the like related to creation of the plasma to control the plasma density which is related to the resonant frequency of the plasma. Thus, in one embodiment of the invention, the signal frequency of the optical signal is approximately the same as the plasma resonance frequency of the antenna.

In another embodiment, of the invention, the internal current distribution of the plasma may be altered to yield a multifunction radiation pattern whereby the plasma antenna has a fixed geometry. In this embodiment, the various electrodes or means for producing the plasma can be controlled during operation to thereby control the radiation pattern.

Antenna system 50 which may be utilized to receive signals may comprise another embodiment of the invention whereby plasma antenna element 52 may be square, rectangular, curved, or bendable to different degrees for focusing and changing the antenna pattern. Note that the above mentioned plasma antennas, such as antennas 22, may also be shaped as desired. Plasma resonant frequency control 51 may be of various constructions such as electrodes, lasers, RF heating, and the like as discussed above for controlling plasma antenna 52 resonant frequency. If desired, resonant frequency control 51 may also control the resonant frequency of antennas 22. In this example, plasma receiver antenna element 52 is driven by one or more optical fibers such as optical fiber 54. Received signals may, if desired, be picked up by electrical wire 56, amplified by preamp 58, and used to produce a modulated laser signal in optical fiber 62. Optical modulator 64 modulates a laser signal from laser 66 which is sent through the periscope by means of optical fiber 68. In this way, both the transmitting and receiving signal through the periscope could be light signals. However, received signals tend to be of much lower power than transmitter driving signals and so produce less interference so that it may also be desirable to simply utilize an electrical wire such as wire 72 in antenna system 70. Thus, the present invention contemplates hybrid systems which may include more typical antenna systems.

It will also be understood that because plasmas are a gas that take on the shape of their container, that in accord with the present invention, the plasma can be put into flexible and/or expandable tubes which can be molded, bent, or formed into various shapes. Thus, elements 28, 30, 32, and 34 may be telescopic or otherwise expandable or shapeable. The plasma may be contained in glass, composite, coated tubes, plastic tubes, or other means. It will be noted that plasmas may be used in many different shapes such as helix or coil 74, purely circular antennas, spirals, and the like.

One method of operation in accord with the present invention utilizes plasma antennas having different plasma resonance frequencies or the possibility of turning some plasma antennas off such as by utilizing plasma control 51. The effect is that some plasma antennas can be made invisible to other antennas so that interference of radiation in the far field from nearby antennas is reduced or eliminated. For instance, a first plasma antenna with a resonance frequency substantially lower than the resonance frequency of a second plasma antenna will be substantially or completely invisible to the second antenna. Thus, even with closely spaced antennas, the interference of far field radiation antennas can be eliminated or reduced.

While a preferred embodiment utilizes the plasma antenna system in a submarine periscope, the plasma antenna system may also be useful for operations in other places such as planes, ships, transports, where antennas may be closely spaced together, require smaller antennas, or require reduced interference.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An antenna system, comprising:

one or more plasma antennas having plasma particles therein;

one or more optical drivers to produce photons for colliding with said plasma particles to thereby induce said one or more plasma antennas to radiate a desired electromagnetic signal; and one or more optical fibers optically connecting said one or more plasma antennas with said one or more optical drivers.

2. The antenna system of claim 1, wherein said one or more optical drivers further comprise one or more lasers.

3. The antenna system of claim 2, further comprising one or more electro-optic modulators for modulating light signals produced by said one or more lasers.

4. The plasma antenna system of claim 3, wherein the electro-optic modulator comprises an optical signal source for producing a light signal modulated with a radio frequency to induce said plasma antenna to transmit said signal.

5. The antenna system of claim 1, wherein said one or more plasma antennas further comprise a plurality of plasma antennas connected as an antenna array to thereby cooperate to transmit said electromagnetic signal.

6. The antenna system of claim 1, further comprising a plasma resonant frequency control for controlling a resonant frequency of said one or more plasma antennas.

7. The system of claim 6, wherein said optical driver is operable for driving said one or more plasma antennas at a frequency within a range of about plus or minus twenty percent of a resonant frequency of said one or more plasma antennas.

8. The antenna system of claim 1, wherein said one or more plasma antennas are formed in a shape related to a desired radiation pattern.

9. The antenna system of claim 8, wherein said one or more plasma antennas have a circular profile.

10. The antenna system of claim 8, wherein said one or more plasma antennas have a rectangular profile.

11. The plasma antenna system of claim 1, wherein said plasma antennas and said optical fiber are mounted as part of a submarine periscope.

12. An antenna system, comprising:

one or more plasma antennas having plasma particles therein;

one or more optical drivers to produce photons for colliding with said plasma particles to thereby induce said one or more plasma antennas to radiate a desired electromagnetic signal;

a first optical fiber connected to a first end of each of said one or more plasma antennas; and a second optical fiber connected to a second end of each of said one or more plasma antennas.

13. The antenna system of claim 12, wherein said first optical fiber is connected at a first position on each of said one or more plasma antennas and said second optical fiber is connected at a second position on each of said one or more plasma antennas, said first position being spaced apart with respect to said second position.

14. A method for controlling a plasma antenna system to avoid interference between a plurality of plasma antennas in close proximity to each other, said method comprising:

operating one of the plasma antennas such that the one plasma antenna has a first plasma antenna resonant frequency; and controlling adjacent plasma antennas such that adjacent plasma antennas are effectively electrically invisible to the one plasma antenna.

15. The method of claim 14, further comprising operating said adjacent plasma antennas such that each adjacent plasma antenna has a second plasma antenna resonant frequency, said second plasma antenna resonant frequency being different from said first plasma antenna resonant frequency.

16. The method of claim 15, wherein said second plasma antenna resonant frequency is lower than said first plasma antenna resonant frequency.

17. The method of claim 14, wherein said second plasma antenna is turned off such that said second plasma container temporarily does not contain a plasma.

18. A method for a plasma antenna, comprising:

controlling a resonant frequency of said plasma antenna; and driving said plasma antenna with a radio signal of the same frequency as said resonant frequency of said plasma antenna within a range of about plus or minus twenty percent.

19. The method of claim 18, further comprising:

driving said plasma antenna with an optical source such that said optical source is modulated by said radio signal;

connecting said optical source to said plasma antenna with one or more optical fibers; and mounting said plasma antenna as part of a submarine periscope.

* * * * *